United States Patent [19]
Kalk
[11] 4,270,371
[45] Jun. 2, 1981

[54] DEVICE FOR UNLOCKING AND LOCKING OF DOORS, PARTICULARLY OF MOTOR VEHICLE DOORS

[75] Inventor: Heinz Kalk, Neu-Isenburg, Fed. Rep. of Germany

[73] Assignee: VDO Adolf Schindling AG, Frankfurt am Main, Fed. Rep. of Germany

[21] Appl. No.: 9,987

[22] Filed: Feb. 6, 1979

[30] Foreign Application Priority Data

Feb. 6, 1978 [DE] Fed. Rep. of Germany ..... 2805004

[51] Int. Cl.[3] ..... E05B 65/38

[52] U.S. Cl. ..... 70/264; 60/412; 180/289

[58] Field of Search ..... 60/407, 411, 412, 433, 60/DIG. 2; 70/91, 263, 336, 264; 49/16, 18, 35; 180/289

[56] References Cited

U.S. PATENT DOCUMENTS

| | | | |
|---|---|---|---|
| 1,925,109 | 9/1933 | Olson | 60/413 X |
| 2,323,519 | 7/1943 | Dean | 60/411 X |
| 2,425,391 | 8/1947 | Parsons | 60/DIG. 2 |
| 3,111,184 | 11/1963 | Oishei | 70/264 X |

*Primary Examiner*—Irwin C. Cohen
*Attorney, Agent, or Firm*—Martin A. Farber

[57] ABSTRACT

A device for unlocking and locking of doors, particularly of motor vehicle doors, with a pump delivering low pressure and high pressure, the outputs of which are connectable via a two-way valve which is actuatable upon each unlocking and locking operation, respectively, with pneumatic positioning elements which act on the door locking mechanism and with electrical switches for switching the pump respectively on and off via a reversing switch, the electrical switches being actuatable by means of a door key and arranged in the several, lockable doors, the reversing switch being able to be switched-over by means of a delayed-responding actuating means. An additional pneumatic positioning element is provided as the delayed-responding actuating means, which additional positioning element is connected to an output of the two-way valve. The two-way valve and the reversing switch are actuatable by means of the additional positioning element.

5 Claims, 1 Drawing Figure

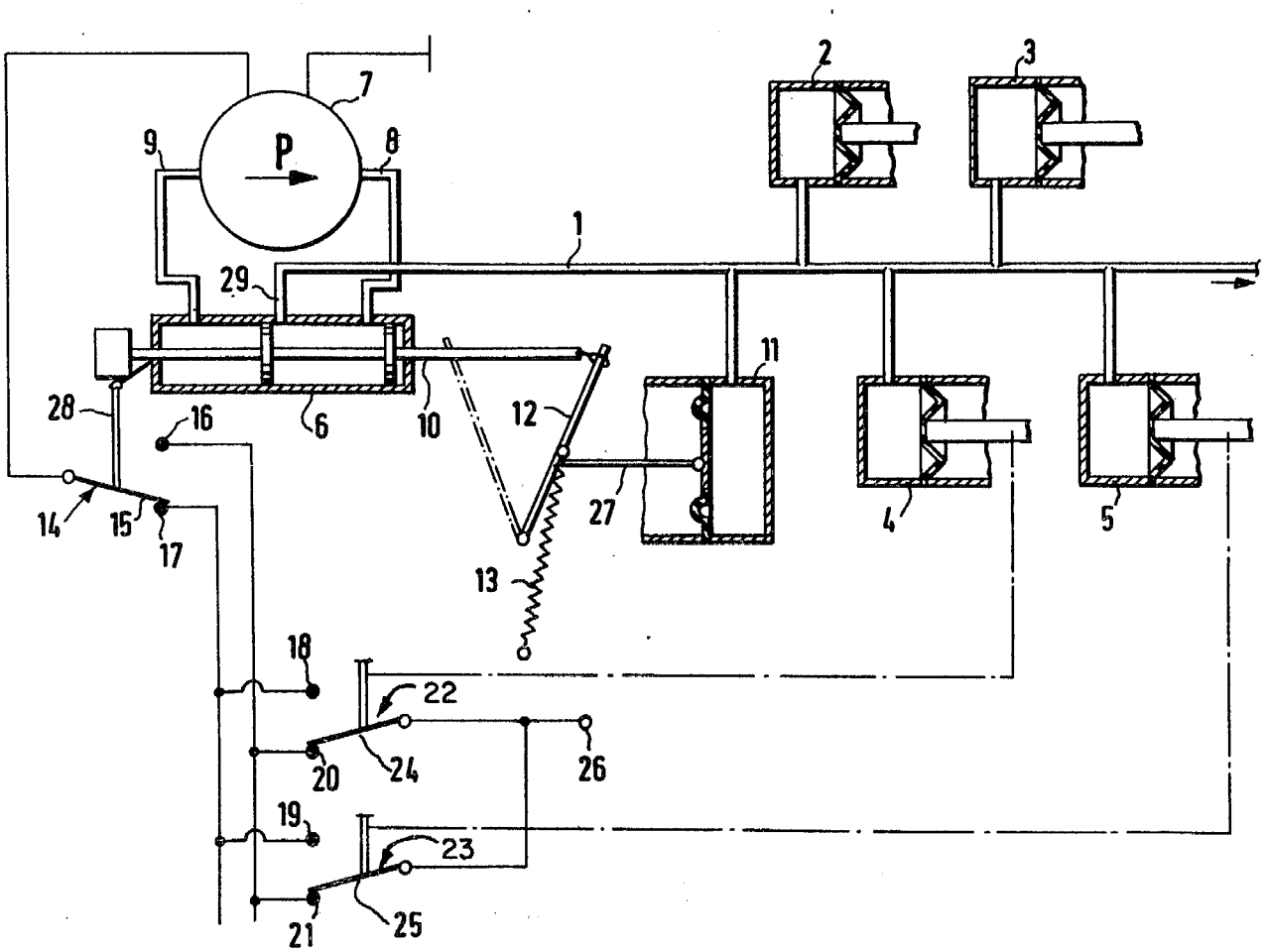
1
2
3
4
5
6
7
8
9
10
11
12
13
14
15
16
17
18
19
20
21
22
23
24
25
26
27
28
29
P

DEVICE FOR UNLOCKING AND LOCKING OF DOORS, PARTICULARLY OF MOTOR VEHICLE DOORS

The invention relates to a device for unlocking and locking of doors, particularly of motor vehicle doors, with a pump delivering low pressure and high pressure, the outputs of which are connectable via a two-way valve which is actuatable upon each unlocking and locking operation, respectively, with pneumatic positioning elements which act on the door locking mechanism and with electrical switches for switching on and switching off, respectively, the pump via a reversing switch, the electrical switches being actuatable by means of a door key and arranged in the several, lockable doors, the reversing switch being able to be switched-over by means of a delayed responding actuating means.

With such a known device which is arranged in a so-called one-line system, the individual pneumatic positioning elements and the servomotors, respectively, for the locking and unlocking are applied with low pressure or below-atmospheric-pressure pulses and high pressure or above-atmospheric-pressure pulses, respectively, which pulses are produced by a pump. Upon actuation of a lock by means of a door key the electrical switch which stands in connection with the lock, which switch is formed as a reversing switch, is switched over or reversed and correspondingly a circuit to a control unit is closed in which the pump starts, in order to actuate the positioning elements. Consequently all door locking mechanisms are unlocked. This condition is also maintained when the one-line system is subsequently vented or evacuated, since the positioning element can occupy two stable positions and snaps-in in each respectively occupied position. This venting of the one-line system occurs in dependency on the control by a delay member in the control unit via the pump. Moreover via an electromagnetic system the delay member actuates a two-way valve which is connected to the pump and to the one-line system and from a high pressure (or above atmospheric pressure) position can be reversed into a low or below atmospheric pressure position and vice versa. Moreover in the control unit there is provided a reversing switch which likewise is actuatable by the electromagnetic system and which on the one hand is electrically connected with the switches which are actuatable by the door key and on the other hand is electrically connected with the pump. Therefor the reversing switch serves to switch the pump off after a certain time which is predetermined by the timing element and to prepare for the next operating instance—locking of the door locking mechanisms.

The locking then takes place by a corresponding actuation of an electrical switch which is actuatable by the door key. In this manner in the given switching position of the reversing switch which is reversed with respect to the first-mentioned operating instance, a high pressure pulse and a low pressure pulse, respectively, is given to the one-line system, which pulse reverses the positioning elements in their two stable positions.

With this known device the comparatively large expense is disadvantageous, which expense opposes the further expansion of this device in motor vehicle construction. Apart from the fact that an additional momentous disadvantage exists in that the control unit with the electromagnetic system and the timing element demand a comparatively great deal of space, so that the control unit no longer can be accommodated in one door of the vehicle, but rather has to be divided in two doors. In this manner the cabling expense is increased.

The present invention is thus based on the object to create a device for unlocking and locking of doors of the introductory-mentioned type, the control unit of which is less expensive and requires less installation space while avoiding the disadvantages of the known device.

This task is aided in its solution in accordance with the present invention in the manner that an additional pneumatic positioning element (11) is provided as the delayed responding actuating means, which additional positioning element is connected to an output (29) of the two-way valve (6), and the two-way valve (6) as well as the reversing switch (14) are actuatable by means of the additional positioning element.

In this manner the essential advantage is achieved that the additional pneumatic positioning element replaces the electromagnetic system for actuation of the two-way valve and of the reversing switch as well as the timing element for the delayed switching or changing-over of the reversing switch. The production expense of the control unit and consequently the entire device is considerably reduced. Since the additional positioning element, differing from the electromagnetic system and the timing element, requires little space, it is possible here to combine all components of the control unit (apart from the pump) and to accommodate them as a spacial or cubical unit in one door.

In an advantageous embodiment of the invention the output (27) of the additional pneumatic positioning element (11) is coupled with a spring (13) which causes a snap action.

In this manner with a simple pneumatic positioning element and with less costly additional means, two stable switching positions are realized.

In a further embodiment the device in accordance with the invention is characterized in a manner that an output (27) of the additional pneumatic positioning element (11), via a lever (12), stands in connection with the two-way valve (6) and the reversing switch (14).

By means of the lever in a simple manner an adaptation or adjustment of the additional positioning element to the two-way valve and to the reversing switch is achieved. The lever can cooperate with the spring for achieving the snap action.

A device is furthermore suitably formed in a manner that the output (27) of the additional pneumatic positioning element (11) is coupled with a piston rod (10) as a control element of the two-way valve (6), which piston rod is connected with an actuating element (28) of the reversing switch (14).

In this manner the coupling of the two-way valve and of the reversing switch with the additional positioning element is brought about in a particularly simple yet reliably acting manner.

Finally a particularly advantageous feature of the device in accordance with the invention is that the additional pneumatic positioning element (11) has a switching point (i.e., an actuating point) with a higher pressure than the pneumatic positioning elements (2, 3, 4, 5) which are in connection with the door locking mechanisms.

In this manner the delayed changing or switching-over is achieved which is only initiated by the additional pneumatic positioning element when the positioning elements which cooperate with the locking mechanisms have assumed their respective new switching position after a pneumatic pulse.

With the above and other objects and advantages in view, the present invention will become more clearly understood in connection with the detailed description of a preferred embodiment, when considered with the accompanying drawing which shows a schematic illustration of a device for unlocking and locking of doors, particularly of motor vehicle doors.

Referring now to the drawing a pneumatic line 1 of a one-line system is illustrated to which there are connected four pneumatic positioning elements 2, 3, 4 and 5. Each positioning element is accommodated in a door (not illustrated) and is coupled with a door locking mechanism (also not illustrated). The positioning elements cooperate bistably with the door locking mechanisms, that is, they have two stable switching positions.

The pneumatic line 1 is fed by a two-way valve 6 which is connected to a pump 7 having a high or above-atmospheric pressure side 8 and a low or below-atmospheric pressure side 9. Depending upon the position of a piston rod 10, which piston rod acts as a control element, the line 1 is applied with high pressure or low pressure.

The piston rod 10 of the two-way valve 6 is actuated by means of the additional pneumatic positioning element 11 which likewise is connected to the line 1. This positioning element has a switching point at 0.4 bar which is higher than the switching point at 0.2 bar of the positioning elements which are coordinated to the door locking mechanisms. In particular the stroke displacement output of the pneumatic positioning element 11 is coupled with the piston rod 10 via a lever 12. Furthermore a spring 13 acts on the lever, which spring causes a snap action, so that the additional pneumatic positioning element 11 also assumes two stable switching positions.

The control unit is completed by a reversing switch 14, which switch is coupled with the piston rod 10 via an actuation element 28 and which switch is correspondingly actuatable by the piston rod. A moveable contact 15 of the reversing switch stands in electrical conducting connection with the pump 7. Fixed contacts 16, 17 of the reversing switch are each connected respectively to one fixed contact 18, 19 and 20, 21, respectively, of the switches 22, 23, which latter switches are formed as door switches. Moveable contacts 24, 25 of the switches 22, 23 are connected with a terminal 26 of a current source, the second pole of which is grounded.

In the illustrated closing (locking) position of the switches 22, 23 all doors may be locked. If now for example the switch 22 which is coordinated to the driver's door is actuated by a door key, then the circuit to the pump 7 is closed via the reversing or selector switch 14 and the pump starts. In the indicated position of the piston rod 10, the higher or above-atmospheric pressure outlet of the pump stands in connection with the line 1 and all pneumatic positioning elements are applied with above-atmospheric pressure. In this manner all locking mechanisms of the doors, which locking mechanisms are coupled with the pneumatic positioning elements 2 to 5, are unlocked, so that these can be opened. Moreover the additional pneumatic positioning element 11 receives an above-atmospheric pressure pulse, which positioning element 11 then, likewise responds however delayed with respect to the positioning elements 2 to 5 as a consequence of the higher switching point, previously mentioned. In this manner via the lever 12 the piston rod 10 is displaced to the left, whereby the reversing switch 14 is brought into its other switching position and the circuit to the pump 7 is interrupted since all door switches 22, 23 clearly have been reversed. In this manner the line 1 with all connected pneumatic positioning elements is vented or evacuated via the pump. Simultaneously as a consequence of the position of the piston rod, which position is shifted to the left, from that shown on the drawing, a lower pressure exists in line 1 since valve 6 connects line 1 to the inlet of pump 7.

Upon a renewed actuation of the switch 22, if namely this switch is brought back into its closing (locking) position shown in the drawing, likewise the circuit to the pump is closed via the reversing switch 14, which pump now produces however low pressure in the line 1 due to the left position of the piston rod 10. In this manner all positioning elements 2 to 5 are switched back and all doors are locked, the positioning element 11 being later reversed with a delayed action. The low pressure disappears, after the predetermined delay time, after which the additional positioning element 11, via the lever 12 and the piston rod 10, adjusts or sets the reversing valve 6 and the reversing switch 14 in the indicated position shown on the drawing, whereby the pump is turned-off and the low pressure pulse is terminated. All switching elements then again assume the position which is illustrated in the drawing and are ready for a new operation.

The switches 22 and 23, respectively, are connected with a moveable part of a pneumatic element as indicated by the dashed lines. That is upon actuation for example of the switch 22 from out of the illustrated postition into its other position, the individual pneumatic elements are actuated and because the moveable part 25 of the switch 23 is thus connected with the moveable part of a servoelement, also the moveable part 25 of the switch 23 is switched out from the indicated position into the other position by the servoelement. The coupling of the switches with corresponding positioning elements is not necessary when only one individual switch 22 or 23, is present, thus for example an electric switch is provided only in the driver's door and is not also provided in the passenger's door.

While there has been disclosed one embodiment of the invention it is to be understood that this embodiment is given by example only and not in a limiting sense.

I claim:

1. In a device for unlocking and locking of doors, particularly of motor vehicle doors, with a pump delivering below atmospheric pressure and high pressure connectable via a two-way valve and a pneumatic line (which valve is actuatable upon each unlocking and locking operation, respectively), with single chamber pneumatic positioning elements which act or a door locking mechanism and with electrical switches for switching the pump on and off, respectively, via a reversing switch, the electrical switches being actuatable by means of a door key and arranged in the lockable doors, respectively, the reversing switch being able to be switched-over by means of a delayed-responding actuating means, the improvement wherein an additional single chamber pneumatic positioning element constitutes the delayed-responding actuating means, said additional positioning element is connected to an output of the two-way valve, and via said valve to the pump, said additional pneumatic positioning element constitutes means for actuating the two-way valve as well as the reversing switch, said means for actuating the two-way valve as well as the reversing switch is for switching said valve and said reversing switch from one condition into another.

2. The device as set forth in claim 1, said means for actuating is defined wherein said additional pneumatic positioning element has an output, and spring means for causing a snap-action is operatively coupled with said output of said additional pneumatic positioning element.

3. The device as set forth in claim 2, further comprising a lever means for connecting said output of said additional pneumatic positioning element with the two-way valve and operatively with the reversing switch.

4. The device as set forth in claim 1, said means for actuating is defined wherein said additional pneumatic positioning element has an output, and a piston rod is coupled with said output of said additional pneumatic positioning element and constitutes a control element of the two-way valve, means for actuating said reversing switch, said actuating means is connected with said piston rod.

5. The device as set forth in claim 1, wherein said additional pneumatic positioning element includes means for providing an actuating point at a higher pressure than the pneumatic positioning elements which are connected with the door locking mechanisms.

* * * * *

UNITED STATES PATENT AND TRADEMARK OFFICE

CERTIFICATE OF CORRECTION

PATENT NO. : 4,270,371

DATED : June 2, 1981

INVENTOR(S) : Heinz Kalk

It is certified that error appears in the above–identified patent and that said Letters Patent are hereby corrected as shown below:

Column 4 Line 58 (claim 1) "or" should read --on--

Signed and Sealed this

*Twenty-fifth* Day of *August 1981*

[SEAL]

*Attest:*

GERALD J. MOSSINGHOFF

*Attesting Officer*

*Commissioner of Patents and Trademarks*